United States Patent [19]

Meyer

[11] 4,088,353

[45] May 9, 1978

[54] DOOR SECURITY LOCK MEANS WITH PANIC KNOB

[76] Inventor: Kirk J. Meyer, 5917 E. 33rd Ct. Apt. 4, Tulsa, Okla. 74135

[21] Appl. No.: 591,177

[22] Filed: Jun. 27, 1975

[51] Int. Cl.[2] ..... E05C 1/12; E05C 9/16

[52] U.S. Cl. ..... 292/36; 292/40; 292/150; 292/336.3; 292/359

[58] Field of Search ..... 70/118, 119, 120; 292/6, 21, 32, 35, 36, 41, 92, 93, 150, 173, 177, 178, 179, 180, DIG. 65, 359, 37, 40, 336.3

[56] References Cited

U.S. PATENT DOCUMENTS

| | | | |
|---|---|---|---|
| 480,075 | 8/1892 | Duncan | 292/359 |
| 2,375,196 | 5/1945 | Cederwall | 70/118 |
| 3,076,328 | 2/1963 | Rhodes et al. | 292/DIG. 65 |
| 3,120,032 | 2/1964 | Burnette | 292/92 X |
| 3,292,399 | 10/1966 | Dyer | 292/40 |

FOREIGN PATENT DOCUMENTS

| | | | |
|---|---|---|---|
| 105,409 | 9/1942 | Sweden | 292/359 |
| 452,812 | 8/1936 | United Kingdom | 292/359 |

*Primary Examiner*—Robert L. Wolfe
*Attorney, Agent, or Firm*—Head, Johnson & Chafin

[57] ABSTRACT

A security lock for doors which may be unlocked from one side of the door only, and comprising sliding bar or pin means selectively engagable with the oppositely disposed door frames for locking the door against entry therethrough by unauthorized personnel. Knob means accessible from one side of the door only is operably connected with the bar means for positively locking thereof in the engaged position with the door frame, and quick relase means is provided for cooperation with the knob means for release of the locking engagement of the bar means with the door frames in order to permit passage through the door under panic conditions, or the like.

1 Claim, 10 Drawing Figures

DOOR SECURITY LOCK MEANS WITH PANIC KNOB

BACKGROUND OF THE INVENTION

1. Field of the Invention

This invention relates to improvements in door locking devices, and more particularly, but not by way of limitation, to a security lock device operable from one side of the door only, and having quick release means for facilitating opening of the door, particularly under panic conditions, or the like.

2. Description of the Prior Art

It is the usual practice in many building constructions, particularly in industrial buildings, such as warehouses, factories, and the like, to provide access doors disposed in areas remotely disposed with respect to the usual or normal entry doors. For example, rear or side doors are frequently provided in large buildings for facilitating evacuation of the building, or permitting leaving of the building for any reason. However, it is usually important to prevent entry of the building through these remote doors by unauthorized personnel, and locking of the doors in a manner precluding entry from the exterior of the building is extremely important. Security locks have been devised for use on doors of this type. However, many of the locking devices are not efficient in that they may be tampered with from the exterior of the door in such a manner as to permit unwanted opening of the door. In addition, many of these locks require keys, or the like, for releasing the locking elements, even from the interior of the building, and this frequently renders the door very difficult to open by the normal personnel working within the building, which is a safety hazard. Under panic conditions, such as a fire, or other catastrophe, it is important that the locked door may be readily opened by the personnel in order to permit evacuation of the building.

SUMMARY OF THE INVENTION

The present invention contemplates a novel security lock means particularly designed and constructed for overcoming the above disadvantages. The novel lock means comprises a pair of oppositely disposed locking pins or bars slidably mounted therein and operably connected with an actuator means which may be manually activated for simultaneously urging the pins outwardly in opposite directions for engagement with the latch means provided in the oppositely disposed door frame. The actuator means is accessible from the interior of the building only, and is particularly constructed for providing a positive locking action for retaining the locking pins or bars in engagement with the latch means for precluding opening of the door, particularly from the exterior of the building. Even in the event the door hinges are removed, the door will be latched in a closed position, and cannot be opened from the exterior. In order to release the locking pins, the actuator may be quickly and easily manually activated whereby the positive locking action on the locking pins is released, and yieldable means quickly releases or moves the locking pins out of engagement with the latch means in order that the door may be opened. This quick release feature greatly facilitates the opening of the door from the interior of the building, particularly under panic conditions. The novel security lock mechanism is simple and efficient in operation and economical and durable in construction.

DESCRIPTION OF THE PREFERRED EMBODIMENTS

Figure 1:
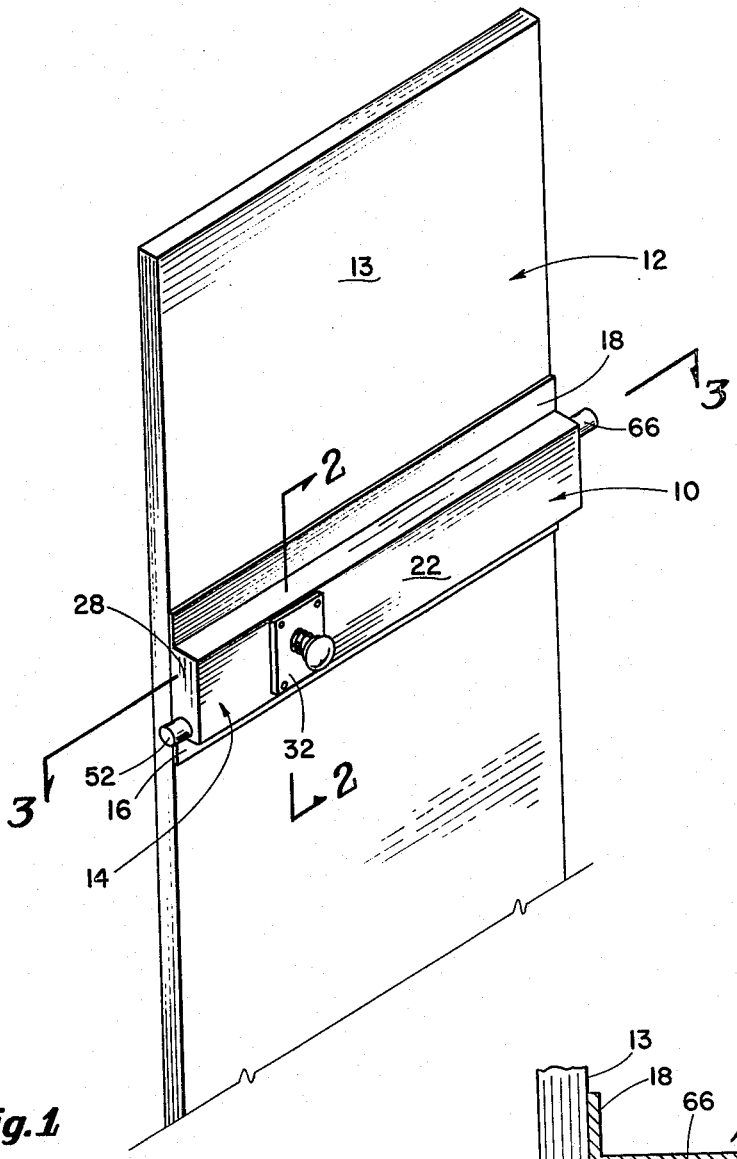
FIG. 1 is a perspective view of a door portion having a security locking mechanism embodying the invention installed thereon.

Referring to the drawings in detail, and particularly FIGS. 1 through 5, reference character 10 generally indicates a security locking mechanism for a door 12, and is adapted to be secured to one face 13 of the door 12 in any suitable manner (not shown), such as by bolting, or the like. The door latching mechanism 10 comprises an outer housing 14 of a length substantially equal to the transverse dimension of the door 12 upon which it is to be installed, and is provided with a pair of oppositely disposed longitudinally extending flanges 16 and 18 adapted to engage the face 13 in order to facilitate securing of the device 10 thereto. An aperture 20 is provided in the exposed front sidewall 22 of the housing 14 and a pair of oppositely disposed apertures 24 and 26 are provided in the end walls 28 and 30, respectively, of the housing 14 for a purpose as will be hereinafter set forth.

Figure 2:
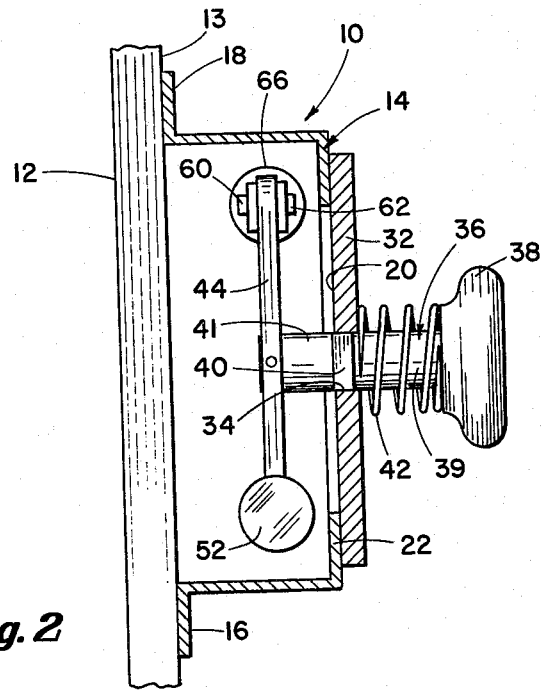
FIG. 2 is a view taken on line 2—2 of FIG. 1, with portions depicted in elevation for purposes of illustration.

A plate member 32 is bolted or otherwise secured to the front wall 22 of the housing 14 and is disposed over the apertures 20 as particularly shown in FIG. 2. A substantially centrally disposed aperture 34 is provided in the plate 32 in alignment with the aperture 20 for receiving the shank or neck 36 of an actuator knob 38 therethrough. The aperture 34 is of a configuration having a plurality of substantially straight sides, as for example, a square. The shank 36 comprises a first portion 39 of a circular cross sectional configuration, a second section 40 of a straightened sided cross sectional configuration complementary to the configuration of the aperture 34, and a third section 41 of a circular cross sectional configuration for a purpose as hereinafter set forth. In addition, suitable stop means (not shown) is preferably provided on the shank 36 for limiting the movement of the shank 36 and knob 38 in the direction away from the plate 32. For example, an outwardly extending flange or washer (not shown) may be secured adjacent the square shank portion 40 oppositely disposed from the plate 32 for engagement therewith to limit the movement of the knob away from the plate. Alternately, the diameter of the circular shank section 41 may be of a size larger than the dimension across the "flats" of the shank portion 40 whereby the shank portion 41 will engage the plate 32 for limiting the outward movement of the knob 38. A suitable helical spring 42 is disposed around the neck or shank 36 and interposed between the plate 32 and the knob 38 for constantly urging the knob 38 in a direction away from the plate 32.

The innermost end of the shank or neck 36 is rigidly secured to a lever arm or crank member 44 in any suitable manner, such as by a pin member 46, and is substantially centrally disposed with respect to the lever 44 to provide a pivot shaft therefor. A fork or yoke member 48 is pivotally secured at 49 to one end of the lever arm 44 for receiving one end of a rod member 50 therein. A locking pin or bar 52 is secured to the opposite end of the rod 50 and extends slidable through the aperture 24. As particularly shown in FIGS. 3, 4 and 5, it is preferable to secure an apertured reinforcing flange 54 on the interior surface of the end wall 28 surrounding the aperture 24. However, it is to be noted that the end wall 28 may be constructed of a sufficiently strong or rigid material for eliminating the need of the reinforcing flange 54, if desired. An outwardly extending flange or stop member 56 is welded or otherwise rigidly secured to the rod 50 in spaced relationship to the angle member 54, and a suitable helical spring 58 is disposed around the bar or pin 52 and anchored between the flange 56 and the angle member 54 for constantly urging the rod 50 and pin member 52 in a direction away from the end wall 28.

A second fork or yoke member 60 is pivotally secured at 62 to the opposite end of the lever arm 44 and extends outwardly therefrom in an opposite direction with respect to the yoke 48 for receiving one end of a second rod 64 therein. A second pin or bar member 66 similar to the pin 52 is secured to the opposite end of the rod 64 and extends slidably through the aperture 26. It is preferable to secure an apertured reinforcing angle member 68 to the inner surface of the end wall 30 in the proximity of the aperture 26. However, the wall 38 may be constructed from a sufficiently rigid or strong material for eliminating the need of a reinforcing member, if desired. A flange 70 similar to the flange 56 is secured to the rod 64 in spaced relation to the flange 68 and a suitable helical spring 72 is disposed around the pin 66 and anchored between the flange 70 and angle member 68 for constantly urging the rod 70 and pin 66 in a direction away from the end wall 30.

The door 12 is preferably installed in the usual doorway (not shown) having oppositely disposed substantially vertical door frames 74 and 76 (FIG. 5) for receiving the door 12 therebetween. A first latch or bar receiving bore 78 is provided in the door frame 74 in substantial axial alignment with the bore 24 for slidably receiving the pin 52 therein. The usual apertured latch plate 80 is preferably secured to the inwardly directed edge of the door frame 74 as is well known. A second latch or bar receiving bore 82 is provided in the door frame 76 in substantial axial alignment with the aperture 26 for slidably receiving the bar 66 therein, and the usual apertured latch plate 84 is preferably secured to the inwardly directed edge of the door frame 76. It is to be noted that the longitudinal axis of the bore 82 is substantially parallel with the longitudinal axis of the bore 78, but is offset therefrom for a purpose as will be hereinafter set forth.

The security locking mechanism 10 may be readily installed on the door 12 by placing the housing 14 against the door face 12 and orientating the housing 14 with respect thereto at the desired height for ease of operation and in such a manner that the pins 52 and 66 extend in opposite directions, and are substantially horizontally disposed. The flanges 16 and 18 may be bolted to the door face 13 in any well known manner for securely retaining the apparatus 10 on the door 12. The bores 78 and 82 may be provided in the door frames 74 and 76 in substantial axial alignment with the pins 52 and 66 for easily receiving the pins 52 and 66 therein. Of course, the latch plates 80 and 84 may be secured to the door frames surrounding the apertures 78 and 82 for protection of the door frames as is well known.

Figure 3:
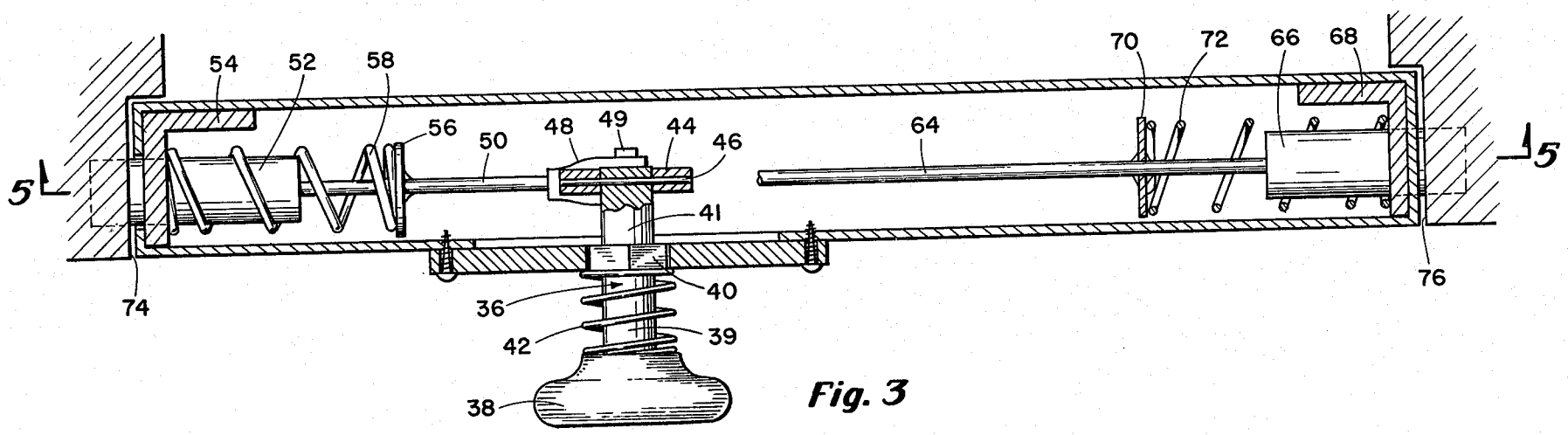
FIG. 3 is a view taken on line 3—3 of FIG. 1, with portions shown in section for purposes of illustration.
Figure 4:
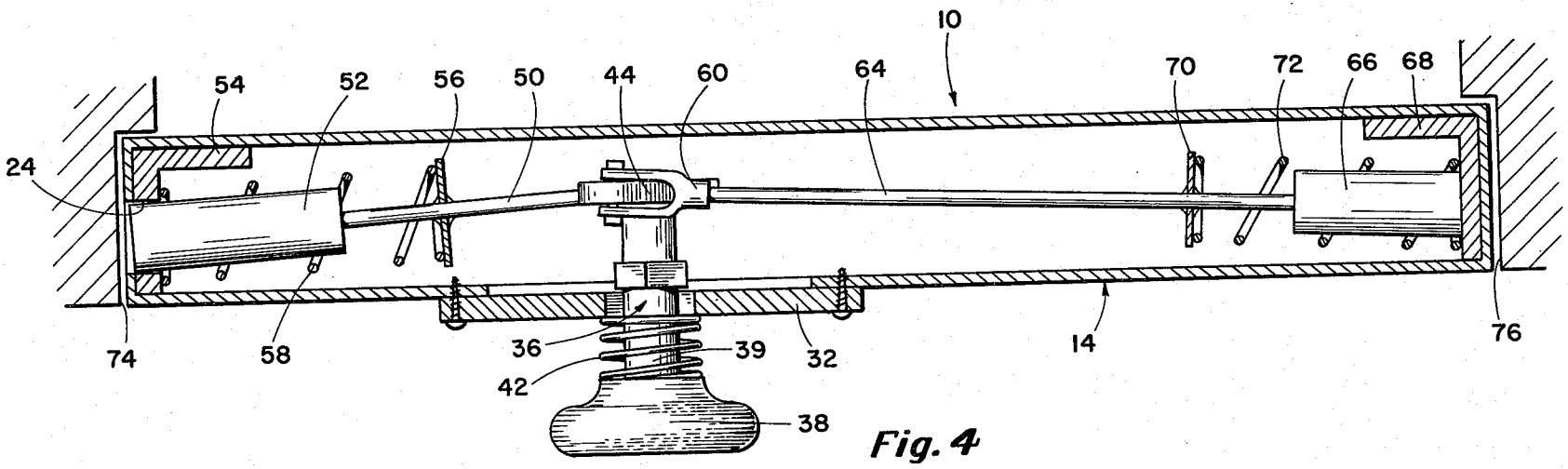
FIG. 4 is a view similar to FIG. 3, and depicts the locking mechanism of the invention in an unlocked position.
Figure 5:
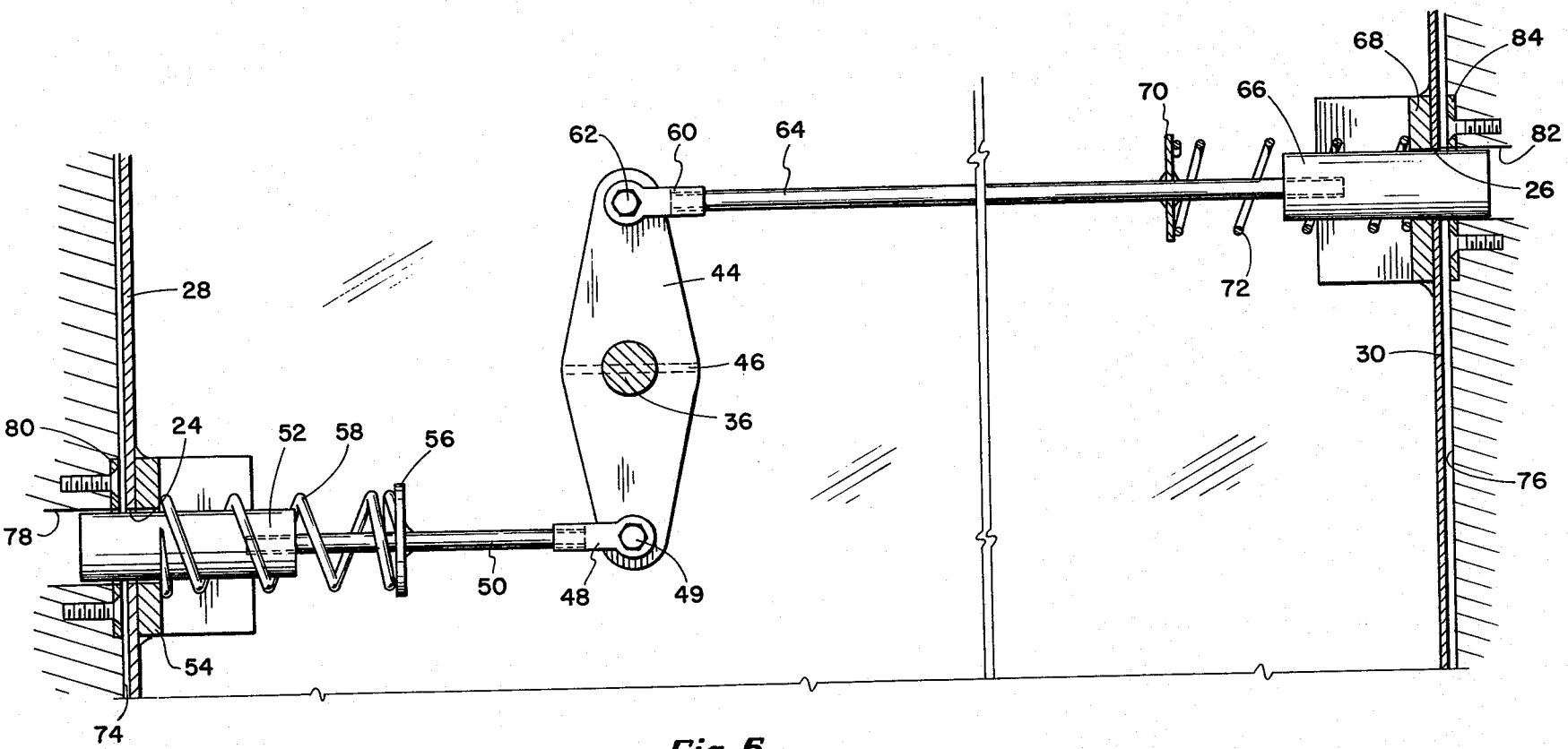
FIG. 5 is a broken view taken on line 5—5 of FIG. 3.
Figure 10:
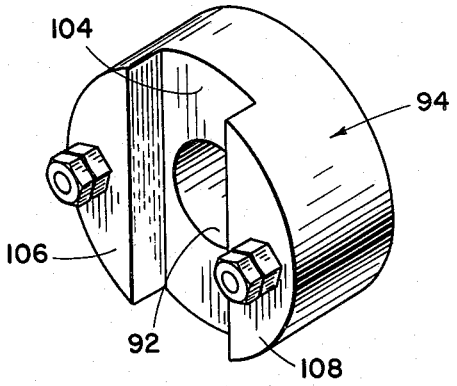
FIG. 10 is a perspective view of a portion of the actuation mechanism shown in FIGS. 6, 7, 8, and 9.
Figure 8:
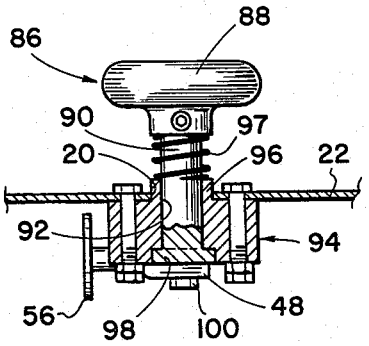
FIG. 8 is a view taken on line 8—8 of FIG. 6.
Figure 9:
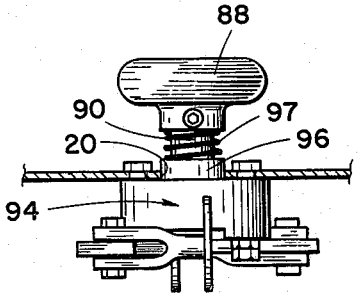
FIG. 9 is a view taken on line 9—9 of FIG. 7.
Figure 6:
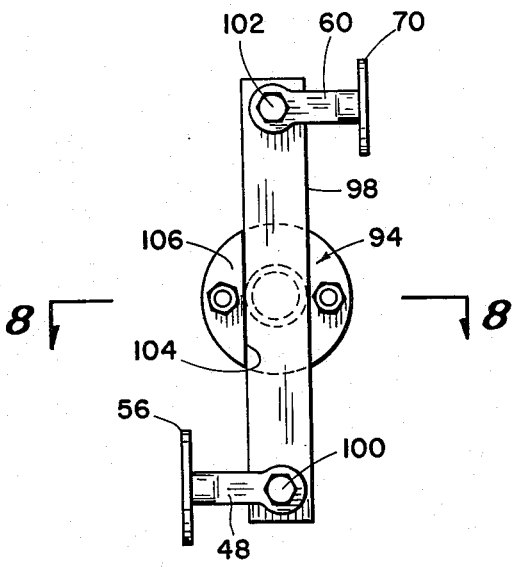
FIG. 6 is a front elevational view of a modified actuation mechanism embodying the invention, and depicted in a latched or locked position.

Referring more particularly to FIGS. 3, 4 and 5, in the normal unlocked position of the mechanism 10 as shown in FIG. 4, the spring 42 holds the knob 38 spaced from the plate 32 limited by the engagement of the portion 40 against the plate 32 whereby the circular portion 30 of the shank 36 is disposed within the aperture 34, thus permitting free manual rotation of the knob 38. When the knob 38 is in this unlocked position, the springs 58 and 72 are free to move the rods 50 and 70, respectively, in directions toward each other whereby the outermost ends of the pins 52 and 66 are resting just within the apertures 24 and 26, respectively, and there is no engagement of the pins 52 and 66 with the bores 78 and 82. When it is desired to lock the door 12 within the door frames 74 and 76, the knob 38 may be manually rotated in a direction for rotating the lever 44 in a clockwise direction as viewed in FIG. 5. This moves the rods 50 and 70 simultaneously in directions away from each other and against the force of the springs 58 and 72. As the rods 50 and 70 are moved away from each other, the pins 52 and 66 are moved into engagement with the bores 78 and 82, respectively, for latching the door 12 within the frames 74 and 76 as shown in FIG. 3. The shank 36 is orientated with respect to the aperture 34 whereby the portion 40 is in alignment therewith and the spring 42 moves the knob 38 outwardly away from the plate 32, bringing the portion 40 into position within the apertured 34. Further outward movement of the knob 38 is precluded by engagement of the stop member (not shown) with the plate 32. As hereinbefore set forth, the stop member may be in the form of an outwardly extending flange or washer secured on the opposite side of the portion 40 with respect to the plate 32, or the diameter of the circular portion 41 may be larger than the flat dimensions of the portions 40 whereby the portion 41 functions as a stop member. The engagement of the portion 40 with the aperture 34 locks the shank or neck 36 against rotational movement, and securely locks the lever 44 in the position wherein the pins 52 and 66 are in locking engagement with the bores 78 and 82.

It is to be noted that the offset relationship of the axes of the bores 78 and 82 eliminate any pivotal axis of the door about a transverse axis. Thus, in the event the hinges (not shown) of the door 12 are removed from the exterior of the door, the door will still remain locked between the frames 64 and 76 for positively precluding entry through the door from the exterior of the building.

In order to unlock the door 12, the knob 38 may be manually pushed against the force of the spring 42 for moving the portion 40 out of engagement with the aperture 34. As soon as the portion 40 is released from the aperture 34, the springs 52 and 70 will quickly pull the pins 52 and 66 from the bores 78 and 82 for unlocking the door 12 from the frames 74 and 76. It will be apparent that this action is quick and easy, thus facilitating opening the door 12 under panic conditions.

Referring now to FIGS. 6 through 10, a modified actuator 85 for the pins 52 and 66 is shown which comprises a knob 88 generally similar to the knob 38 and having a shank or neck member 90 secured thereto extending slidably and rotatably through a central aperture 92 of a hub member 94. The hub member 94 is bolted or otherwise rigidly secured to the inner surface of the front wall 22 of the housing 14, and is provided with a boss member 96 which extends through the apertures 20 of the wall 22. A suitable helical spring 97, similar to the spring 42, is disposed around the shank 90 and anchored between the boss member 96 and the knob 88 for constantly urging the knob 88 in a direction away from the hub 94.

A lever arm 98 is secured to the outer extremity of the shank 90 in any suitable manner and is rotatable simultaneously therewith in a manner and for a purpose as will be hereinafter set forth. The fork or yoke member 48 is pivotally secured at 100 to one end of the lever arm 98, and the fork or yoke member 60 is pivotally secured at 102 to the opposite end of the arm 98. The yoke members 48 and 60 receive one end of the rods 50 and 64, respectively, therein as hereinbefore set forth, and the flanges 56 and 70 may either be secured to the rods 50 and 64 as hereinbefore set forth, or may be rigidly secured to the outer end of the yoke members 48 and 60, as desired.

The hub member 94 is preferably of a substantially circular configuration, but not limited thereto, and is provided with a recess 104 extending diametrically thereacross for intermittently receiving the lever arm 98 therein for a purpose as will be hereinafter set forth.

Figure 7:
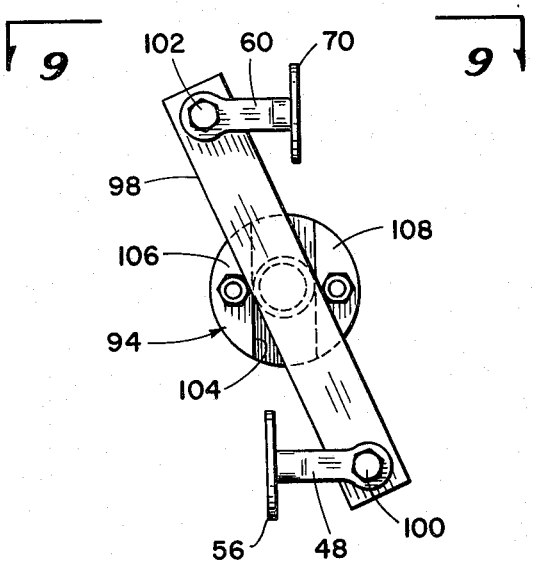
FIG. 7 is a view similar to FIG. 6, and depicts an unlocked position.

In order to place the latching mechanism 86 in the unlocked position, as particularly shown in FIG. 7, the knob 88 is manually pushed in a direction toward the wall 22 and against the force of the spring 97 in order to disengage the lever 98 from engagement with the slot 104. As soon as the lever 98 is released from the locking engagement with the slot 104, the knob 88 may be manually rotated in a direction for rotating the lever 98 in a counterclockwise direction as viewed in FIG. 7, or in a direction for moving the rods 50 and 64 in directions toward each other. As hereinbefore set forth, this movement pulls the pin members 52 and 66 inwardly until the outer extremities thereof merely rest in the apertures 24 and 26. The force of the spring 97 constantly urges the knob 88 in a direction away from the hub 94, and as a consequence, the lever 98 is urged into a tight engagement with the outer surfaces 106 and 108 of the hub 94 adjacent the recess 104, and frictional engagements between the lever 98 and the flat surfaces 106 and 108 in combination with the force of the springs 56 and 70 hold the pins 52 and 66 in this inward position.

In order to lock the door 12 in the door frames 74 and 76, the knob 88 may be manually rotated in an opposite direction whereby the lever 98 will be brought into substantial alignment with the recess 104. In this position, the spring 97 quickly pulls the lever 98 into the recess 104 as particularly shown in FIGS. 6 and 8. As the lever 98 is rotated to this locked engagement with the recess 104, the rods 50 and 64 are moved in directions away from each other and against the force of the springs 56 and 70, and the pins 52 and 66 are moved into engagement with the bores 78 and 82.

From the foregoing it will be apparent that the present invention provides a novel security locking mechanism for doors wherein it is desirable to provide access therethrough from one side of the door only. The novel latching or locking mechanism comprises lever means rotatable by actuator means for quickly and easily inserting locking pins or bars in door facing latching bores. The actuator means also permits a quick release of the locking mechanism particularly for facilitating opening of the door unde panic conditions, such as in the case of a fire, or other catastrophe. The longitudinal axes of the locking pins in the latched position thereof are offset whereby no transverse pivot axis is present on the locked door, thus further precluding access through the door from the exterior of the building.

Whereas the present invention has been described in particular relation to the drawings attached hereto, it should be understood that other and further modifications, apart from those shown or suggested herein, may be made within the spirit and scope of this invention.

What is claimed is:

1. In combination with a door mounted in a door frame, door locking means comprising a housing, means for securing the housing to one face of the door, actuator means extending through the housing, a lever member disposed within the housing and operably connected to the actuator means, locking pin means operably connected directly to the lever member and slidably extending through aperture means provided in the housing, said actuator means being rotatable in one direction for actuation of the lever member to move the pin means outwardly through said housing aperture means and into aperture means provided in the door frame for locking of the door, yieldable means cooperating with the housing and pin means for constantly urging the pin means toward an unlocked position, means cooperating between the housing and actuator means for retaining the pin means in said locked position, said actuator being operable for actuation of the lever member to release the pin means from said locking position, and wherein the actuator means comprises knob means disposed exteriorly of the housing, shank means carried by the knob means and extending into the housing for connection with the lever means, hub means secured within the housing and around the shank means, yieldable means disposed around the shank means and anchored between the hub means and knob means for constantly urging the knob means in a direction away from the hub means, recess means provided on the exposed face of the hub means for intermittently receiving the lever means therein, said shank means being movable against the force of the yeildable means by the knob means for disengaging the lever means from the recess means to provide said unlocked position, and said knob being rotatable in one direction for actuation of the lever member to provide said locking position.

* * * * *